United States Patent [19]

Derichs

[11] Patent Number: 4,660,373

[45] Date of Patent: Apr. 28, 1987

[54] METHOD AND DEVICE FOR STARTING AN OPEN-END ROTOR SPINNING MACHINE

[75] Inventor: Josef Derichs, Mönchengladbach, Fed. Rep. of Germany

[73] Assignee: W. Schlafhorst & Co., Moenchengladbach, Fed. Rep. of Germany

[21] Appl. No.: 749,499

[22] Filed: Jun. 27, 1985

[30] Foreign Application Priority Data

Jun. 27, 1984 [DE] Fed. Rep. of Germany ..... 3423645

[51] Int. Cl.[4] ..... D01H 7/882; D01H 13/00

[52] U.S. Cl. ..... 57/404; 57/78; 57/105

[58] Field of Search ..... 57/400, 404, 78, 263, 57/264, 92, 104, 105, 268

[56] References Cited

U.S. PATENT DOCUMENTS 3,936,998 2/1976 Wolf ..... 57/92 X
3,952,491 4/1976 Sharychenkov ..... 57/263
4,043,106 8/1977 Stahlecker ..... 57/263
4,080,775 3/1978 Stahlecker ..... 57/263

FOREIGN PATENT DOCUMENTS 47723 3/1982 European Pat. Off. ..... 57/264

*Primary Examiner*—John M. Jillions
*Assistant Examiner*—Joseph J. Hail, III
*Attorney, Agent, or Firm*—Herbert L. Lerner; Laurence A. Greenberg

[57] ABSTRACT

A method for starting an open-end rotor spinning machine, including rotors, a tangential belt guided along the spinning machine for driving the rotors and functional connections between the rotors and the tangential belt includes interrupting the functional connections between the rotors and the tangential belt, subsequently beginning to drive the tangential belt, subsequently acclerating the tangential belt to a speed conforming to that of a spinning operation, and successively re-establishing the functional connections between the rotors and the tangential belt, and a device for carrying out the method.

12 Claims, 3 Drawing Figures

Figure 1:
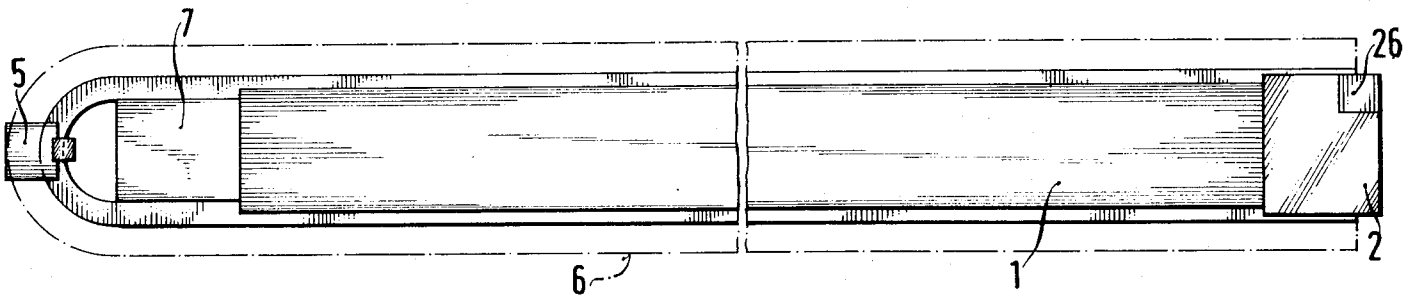

FIG. 2
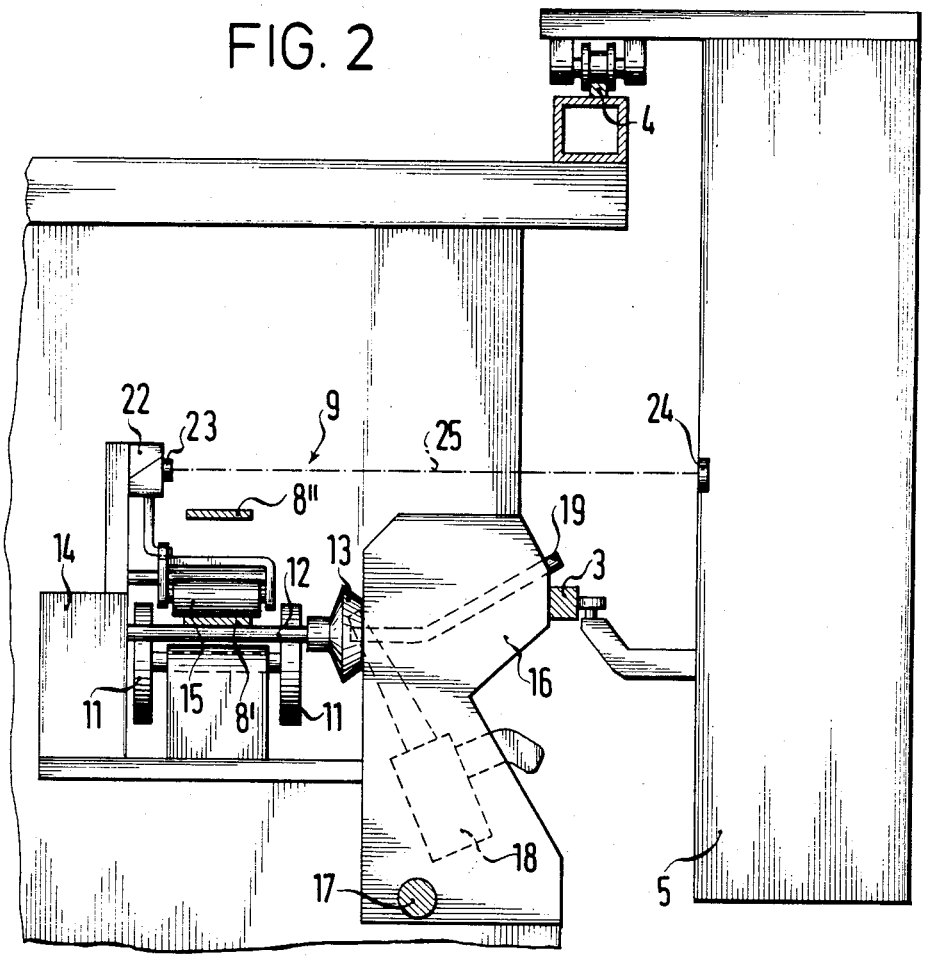
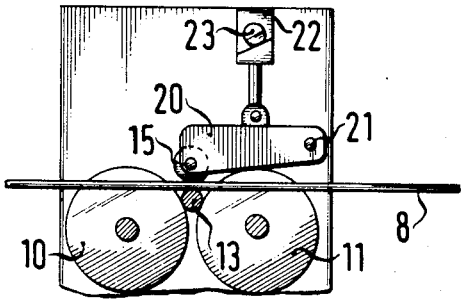
FIG.3

METHOD AND DEVICE FOR STARTING AN OPEN-END ROTOR SPINNING MACHINE

The invention relates to a method and device for starting an open-end rotor spinning machine, having rotors driven by a tangential belt guided along the spinning machine.

When starting such an open-end rotor spinning machine under full load, very heavy loads are applied to the tangential belt and its drive due to inertia. All of the rotors and all of the parts rotating with the rotors must be accelerated at the same time, so that more energy is also required for this purpose. Furthermore, to provide for starting under such a heavy load, the drive of the tangential belt must be made larger and must be correspondingly dimensioned or over-dimensioned. As a result, starting under a full load requires higher expenditures.

It is accordingly an object of the invention to provide a method and device for starting an open-end rotor spinning machine, which overcomes the hereinaforementioned disadvantages of the heretofore-known methods and devices of this general type, and to avoid the heavy load occurring at the start of an open-end-rotor spinning machine.

With the foregoing and other objects in view there is provided, in accordance with the invention, a method for starting the operation of an open-end rotor spinning machine, including rotors, a tangential belt guided along the spinning machine for driving the rotors and functional connections between the rotors and the tangential belt, which comprises interrupting the functional connections between the rotors and the tangential belt, subsequently beginning to drive the tangential belt or the drive thereof, or a functional connection between the drive and the belt is established, subsequently accelerating the tangential belt to a speed conforming to that of or being suitable for a spinning operation; and successively re-establishing the functional connections between the rotors and the tangential belt.

According to this method, the tangential belt is first accelerated up to operational speed without a load, for which purpose no increased drive power is necessary. Then the rotors are brought in contact with the tangential belt, either directly or with the interposition of some gearing. Since each individual rotor uses only very little power, the load does not increase in noticeable jumps.

In order to implement the method there is provided a device for starting an open-end rotor spinning machine with rotors disposed at spinning stations, comprising a tangential belt guided along the spinning machine for driving the rotors, and at least one switchable coupling device including means for progressively establishing or coupling functional connections between the rotors in a heretofore decoupled or stand-still condition and the tangential belt in a running condition, from spinning station to spinning station.

Starting from the de-coupled state, if a coupling device is provided at each spinning station, provisions are made to ensure that not all spinning stations are started at the same time, but rather that they are started sequentially, one after the other, in a not-too-rapid sequence. If there is only a single coupling device, this coupling device must be applied and operated sequentially at one individual spinning station after the other.

Up to this point only coupling devices have been mentioned, and decoupling devices have not been discussed. For example, the decoupling can be done manually, for instance, when the belt stands still.

However, in accordance with another feature of the invention the at least one coupling device includes means for interrupting or decoupling the functional connections between all of the rotors and the tangential belt.

If only one single decoupling device of such a type is provided, it can be disposed at a central point in a control console, for example. It could be connected by electric lines to the various control elements, for instance, which disconnect the individual rotors from the tangential belt. For example, if these control elements are in the form of gearing, controllable clutches could be used.

In accordance with a further feature of the invention, there are provided means for centrally controlling the means for establishing functional connections and the means for interrupting functional connections.

Such central control means could also be thought of as a part of the coupling device, depending on the way one considers it.

In accordance with an added feature of the invention, there is provided a stationary control console in which the central control means are disposed.

In accordance with an additional feature of the invention, there is provided a carriage traveling along the spinning machine, at least part of the coupling device being disposed on the carriage.

In accordance with yet another feature of the invention, the coupling device includes a pressure roller for pressing against the tangential belt, and the carriage includes means for controlling or shifting the pressure roller.

Such a tangential belt pressure roller is the element which makes the force transmitting functional connection between the tangential belt and the rotor, if the rotor is supported on support rollers, for example, and is directly driven by the tangential belt, which contacts the rotor shaft. The above-described pressure roller for the tangential belt is necessary in each case for this direct drive and for holding the rotor shaft on the support rollers.

If a coupling device as well as a decoupling device are provided and if these devices are to be operated either automatically or semi-automatically, it is advantageous to simplify the whole apparatus even further.

Therefore, in accordance with yet a further feature of the invention, there is provided a common control element for controlling the means for establishing functional connections and the means for interrupting functional connections.

In a final version, the coupling device and the decoupling device can be combined to form an integral mechanism.

In accordance with yet an added feature of the invention, the coupling device includes a pressure roller pressing against the tangential belt and a movable support and bearing device for the pressure roller, and the common control element is a setting motor or actuator connected to the movable support and bearing device.

For example, the pressure roller for the tangential belt can be supported on a rocker arm and either by gravity or by additional spring forces which lie against the tangential belt above the rotor shaft. The rocker arm is constructed in such a way that it can be raised or pivoted upward by the setting motor, so that the tangential belt pressure roller looses it contact with the rotor shaft. Even if occasional swinging motions of the tangential belt cause the belt to touch the rotor shaft at times, there is hardly any drive force applied to the rotor by the tangential belt if the setting motor pivots the movable support of the pressure roller upward, as described above.

The setting motor can be a hydraulic, pneumatic, or electro-mechanical actuator, to name only a few examples.

In accordance with yet an additional feature of the invention, the setting rotor is a control electric magnet or solenoid.

Such electro-magnets operate rapidly and develop considerable attraction moments, so that in the retracted state they consume relatively little electric energy.

In accordance with a concomitant feature of the invention, there is provided a carriage traveling along the spinning machine, a radiation or light source disposed on said carriage, and an opto-electric switch being connected to said setting motor and being influenced by said radiation source.

An electro-magnet for shifting the tangential belt pressure roller can also be installed in existing spinning machines. Although it requires an energy supply, it needs only simple electric lines. Its opto-electric switch responds only to light or radiation of a selected frequency, similar to electric light gates. If such a light source is mounted on a carriage which can travel along the spinning machine, it can emit a narrow radiation beam at the height of the opto-electric switch. If the carriage travels at the required speed, i.e. not too slow and not too fast, along the spinning machine, it can sequentially energize all of the control magnets with a first pulse and thereby interrupt the functional connections between all of the rotors and the tangential belt. Later on, the control magnets can be de-energized with a second radiation pulse at the desired point in time, so that the functional connections between the rotors and the tangential belt are subsequently established again in sequence.

Other features which are considered as characteristic for the invention are set forth in the appended claims.

Although the invention is illustrated and described herein as embodied in a method and device for starting an open-end rotor spinning machine, it is nevertheless not intended to be limited to the details shown, since various modifications and structural changes may be made without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic, top-plan view of an open-end rotor spinning machine; and FIG. 2 is a fragmentary, side-elevational view of parts of a spinning machine of an open-end rotor spinning machine, including more than 100 spinning stations; and FIG. 3 is a fragmentary, front-elevational view showing details of a functional or operative connection between the tangential belt and the rotor of the device.

Referring now in detail to FIGS. 1–3 of the drawings as a whole, there is seen an open-end rotor spinning machine which is constructed as a two-sided machine with a stationary control console 2. A carriage 5 can travel around the head end 7 of the open-end rotor spinning machine 1 on rails 3,4 of a track 6 at both sides of the spinning machine.

A tangential belt 8 is guided on each side of the machine along every spinning station of the respective machine side. FIG. 2 shows the lower portion 8' and the upper portion 8'' of the tangential belt 8, in section.

At a spinning station 9, which is partially shown in FIG. 2, two pairs of support rollers 10 and 11 are provided for the shaft 12 of a rotor 13. A retainer bearing 14 prevents the deviation of the rotor shaft 12 toward the back.

During the spinning operation, the lower portion 8' of the tangential belt lies directly on the rotor shaft 12 and is pressed against the rotor shaft by a pressure roller 15 for the tangential belt.

In front of the rotor 13 is a spinning box 16 which can be swung forward about a pivot axis 17. The spinning box 16 contains additional components required for the spinning operation, such as a fiber feeding device 18 and a thread withdrawal tube 19.

The tangential belt pressure roller 15 is connected to a coupling device in the form of a movable bearing support 20, which is constructed as a rocker arm that pivots about a pivot point 21. In the coupled state, the functional or operative connection between the tangential belt 8 and the shaft 12 of the rotor 13 is accomplished by the fact that the weight of the rocker arm 20 causes the tangential belt pressure roller 15 to press with the desired force onto the tangential belt 8, exactly on top of the shaft 12.

The coupling device 20 is combined with a decoupling device 22 in the form of a control magnet or solenoid which represents a common control element, according to the invention of the instant application. The control element 22 serves as an actuating motor for the tangential belt pressure roller 15.

The actuating motor 22 is provided with an opto-electric switch 23, which can be triggered by a radiation source 24. The source 24 is provided on the carriage 5, so that it can travel along side the spinning machine 1. The opto-electric switch 23 is a pulse activated switch, which is constructed in such a way that it de-energizes the actuating motor 22 upon the occurence of a first radiation pulse which activates the coupling device 20, and energizes the decoupling motor 22 again upon the occurence of a second radiation pulse which lifts the pressure roller 15 from the tangential belt 8.

During the time that the carriage 5 travels along one of the two sides of the open-end rotor spinning machine 1, the radiation source 24 remains continuously "on" and therefore serves together with the carriage 5 as a central control device for all of the decoupling devices 22. The light ray bundle 25 from the source 24 hits the opto-electric switches 23 of the actuators one after the other in sequence. For this purpose, all of the opto-electric switches are placed at the same height.

It should also be noted at this point that the carriages 5 can also serve other functions depending on the degree to which the open end spinning machine is automated. For instance, the carriage 5 can control the opening and closing of the spinning box 16, the cleaning of the interior of the rotor, or the start of spinning or joining of a thread.

The invention is not limited to the illustrated and described embodiment which is used as an example. For example, a central control device 26 can be provided in the control console 2 with an electrical connection to the individual actuating motors 22. In this case, the control device 26 would contain a conventional stepper-control mechanism, which operates the actuating motors 22 in sequence and thereby alternatingly, or simultaneously operates the decoupling and coupling devices depending on the way that the operation is seen to take place.

I claim:

1. Method for starting an open-end rotor spinning machine having adjacent spinning stations, including rotors with shafts, a tangential belt guided along the spinning machine for driving the shafts of the rotors and functional connections between the shafts of the rotors and the tangential belt, which comprises unloading the tangential belt while removing the tangential belt from the shafts of all of the rotors for interrupting the functional connections between the shafts of all of the rotors and the tangential belt, subsequently beginning to drive the tangential belt while maintaining all of the shafts of the rotors in a disengaged condition at the same time, subsequently accelerating the tangential belt to a speed conforming to that of a spinning operation while maintaining all of the shafts of the rotors in a disengaged condition at the same time, and successively re-establishing the functional connections between the shafts of the rotors and the tangential belt at adjacent spinning stations.

2. Device for starting an open-end rotor spinning machine having rotors with shafts disposed at spinning stations, comprising a tangential belt guided along the spinning machine for driving the shafts of the rotors, and at least one switchable coupling device including: means for unloading the tangential belt while removing the tangential belt from the shafts of all of the rotors, means for subsequently beginning to drive the tangential belt while maintaining all of the shafts of the rotors in a disengaged condition at the same time, means for subsequently accelerating the tangential belt to a speed conforming to that of a spinning operation while maintaining all of the shafts of the rotors in a disengaged condition at the same time, and means for progressively establishing functional connections between the shafts of the rotors in a decoupled condition and said tangential belt in a running condition, from spinning station to adjacent spinning station.

3. Device according to claim 2, wherein said at least one coupling device includes means for interrupting the functional connections between all of the shafts of the rotors and said tangential belt.

4. Device according to claim 3, including means for centrally controlling said means for established functional connections and said means for interrupting functional connections.

5. Device according to claim 4, including a stationary control console in which said central control means are disposed.

6. Device according to claim 2, including a carriage traveling along the spinning machine, at least part of said coupling device being disposed on said carriage.

7. Device according to claim 3, including a carriage traveling along the spinning machine, at least part of said coupling device being disposed on said carriage.

8. Device according to claim 6, wherein said coupling device includes a pressure roller for pressing against said tangential belt, and said carriage includes means for controlling said pressure roller.

9. Device according to claim 3, including a common control element for controlling said means for establishing functional connections and said means for interrupting functional connections.

10. Device according to claim 9, wherein said unloading and removing means includes a pressure roller pressing against said tangential belt and a movable support and bearing device for said pressure roller, and said common control element is a setting motor connected to said movable support and bearing device.

11. Device according to claim 10, wherein said setting motor is a control magnet.

12. Device according to claim 10, including a carriage traveling along the spinning machine, a radiation source disposed on said carriage, and an opto-electric switch being connected to said setting motor and being influenced by said radiation source.

* * * * *